United States Patent [19]

Wilson

[11] Patent Number: 4,861,305

[45] Date of Patent: Aug. 29, 1989

[54] CHILD'S CRIMINAL INVESTIGATIVE GAME KIT

[76] Inventor: Rickey D. Wilson, 25941 E. 9 St., #50, San Bernadino, Calif. 92410

[21] Appl. No.: 215,415

[22] Filed: Jul. 5, 1988

[51] Int. Cl.[4] ..... A63H 33/04; A63H 33/30

[52] U.S. Cl. ..... 446/75; 446/473

[58] Field of Search ..... 446/75, 76, 77, 78, 446/478, 473; 434/224, 262, 265, 298, 301; 206/223, 232, 570; 220/23; D3/30.1, 76, 77; D8/306

[56] References Cited

U.S. PATENT DOCUMENTS

| | | | |
|---|---|---|---|
| D. 123,466 | 11/1940 | Worthington | D8/306 |
| D. 265,346 | 7/1982 | Maier | D3/30.1 |
| D. 281,289 | 11/1985 | Graham | D3/30.1 |
| 1,350,237 | 8/1920 | Porter | 434/298 |
| 1,653,246 | 12/1927 | Zichy | 206/223 |
| 2,671,623 | 3/1954 | Toulmin | 244/138 R |
| 2,982,392 | 5/1961 | Bossone | 224/273 |
| 3,216,135 | 11/1965 | Wright | 206/232 |
| 3,254,756 | 6/1966 | Rankin | 206/229 |
| 3,420,361 | 1/1969 | Newberg | 206/223 |
| 3,594,923 | 7/1971 | Midgley | 434/298 |
| 3,741,382 | 6/1973 | Larimer | 206/573 |
| 3,951,260 | 4/1976 | Frazee | 206/579 |
| 4,437,568 | 3/1984 | Hamblin | 206/223 |
| 4,478,330 | 10/1984 | Lin | 206/232 |
| 4,696,652 | 9/1987 | Reeder et al. | 446/75 |
| 4,742,911 | 5/1988 | Manuel | 206/232 |

*Primary Examiner*—Robert A. Hafer
*Assistant Examiner*—Michael Brown
*Attorney, Agent, or Firm*—Leon Gilden

[57] ABSTRACT

A child's investigative game kit is set forth as an educational and teaching tool directed at children for enhancing a child's investigative, deductive, and cooperative skills. A securable transportable container is formed with a pivotal door securable to the container for maintaining contents stored therein. The container is formed with a plurality of flexible pockets in the door for positioning of various elements of the game kit including an arm band, a wallet-badge, a compass, a whistle, a flashlight, a pen, and a note inscribing book. Secured to an interior surface of the door also is a LED clock for time indication. Horizontal storage compartments are vertically arranged within the container including binoculars, a plurality of hand-held communication radios, a camera, and a plurality of slidable drawers underlying the above compartments for storage of miscellaneous items associated with the kit.

3 Claims, 6 Drawing Sheets

INITIATION CARD

I SOLEMNLY SWEAR TO ALWAYS BE FAITHFUL TO THE CRIME BUSTERS OF AMERICA CLUB AND TO MY PARENT(S) OR GUARDIAN(S).

I PROMISE NOT TO INTERFERE OR TAKE THE LAW INTO MY OWN HANDS.

I PROMISE TO REPORT ANY WRONGDOING I SEE TAKING PLACE.

I PROMISE NOT TO STEAL AND RESPECT OTHER PEOPLE'S PROPERTY.

I PROMISE TO GET OTHERS WITH QUALITIES LIKE MINE TO JOIN THIS CLUB.

I PROMISE TO TAKE GOOD CARE OF MY EQUIPMENT BECAUSE TOGETHER WE ARE A TEAM

46

MEMBERS SIGNATURE

PARENTS SIGNATURE

FIG. 4

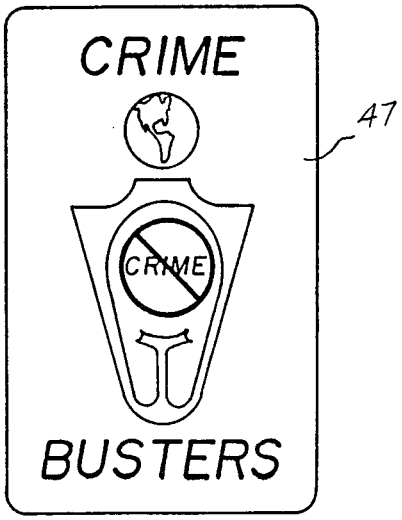

FIG. 5

CHILD'S CRIMINAL INVESTIGATIVE GAME KIT

BACKGROUND OF THE INVENTION

1. Field of the Invention

The field of invention relates to educational game kits, and more particularly pertains to a new and improved child's criminal investigative game kit to enhance a child's investigative and deductive skills while simultaneously influencing cooperation with a peer group.

2. Description of the Prior Art

Kits of various purposes and including various items to attains that purpose have been presented in the prior art. While children's games and various miscellaneous items, as utilized by children in the playing of games, such as binoculars and the like, is known in the prior art, but the various items have heretofore not been assembled in a synergistic cooperative relationship to enhance a child's investigative and cooperative skills in participating with others while influencing and teaching of desired social moral values to a child.

Prior art kits, as noted, are well established in the prior art. For example, U.S. Pat. No. 2,671,623 to Toulmin sets forth a communication and shelter apparatus for particular use by an aerial delivery carrier wherein various items such as a generator for providing power to operate various radios and the like as well as associated maps, flares, food rations, ammunition, etc. are utilized for survival purposes as may be required by an aerial delivery carrier traversing remote regions. The Toulmin patent is of interest relative to the prior art teaching of assembling various components for a singular purpose.

U.S. Pat. No. 2,982,392 to Bossone sets forth a safety kit for use in a motor vehicle including such items as a fire extinguisher, tape, flashlight, and the like positionable within recesses of a transportable container for providing an assembly of articles as may be utilized as a safety kit in the operation of a motor vehicle.

U.S. Pat. No. 3,254,756 to Rinkin sets forth another motor vehicle or truck type safety kit including fire extinguishers, flares, etc. as may be desired in dealing with emergencies in the operation of trucks.

U.S. Pat. No. 3,371,771 to Bugyi sets forth yet another emergency safety kit utilizing various securable items therewithin such as a lantern, fire extinguisher, and flares, for example, as may be utilized in a safety kit secured with a transportable package.

U.S. Pat. No. 3,741,382 to Larimer sets forth another highway safety kit wherein a container of gasoline is secured within a foam-like protective case with an associated "help" sign with the entire assemblage securable within an associated package.

U.S. Pat. No. 3,951,260 to Frazee sets forth a survival kit wherein an aerial gas inflatable balloon may be utilized for alerting others of an individuals undesirable predicament wherein the kit further includes items such as water purification tablets, matches, snake bite antivenom material, and other first aid material, as may be utilized by an individual requiring emergency assistance in remote areas.

U.S. Pat. No. 4,437,568 to Hamblin sets forth a fire and smoke emergency kit provided with a hingedly securable front including emergency clothing, breathing apparatus, and a fire extinguisher as may be utilized by an individual in combating the effects of fire and alerting others to such a problem.

As such, it may be appreciated that there is continuing need for a child's criminal investigative game kit that may be utilized to enhance a child's deductive skills as well as teaching a value system based on criminology detection and cooperation with others. In this respect, the present invention substantially fulfills this need.

SUMMARY OF THE INVENTION

In view of the foregoing disadvantages inherent in the known types of accessory kits now present in the prior art, the present invention provides an child's criminal investigative game kit wherein the same includes a plurality of cooperative and synergistic items to enhance a child's communicative, investigative, and deductive skills as well as enhancing a cooperative relationship with an associate peer group. As such, the general purpose of the present invention, which will be described subsequently in greater detail, is to provide a new and improved child's criminal investigative game kit which has all the advantages of the prior art specialized purpose kits and none of the disadvantages.

To attain this, the present invention comprises a selectively securable carrying case including an upwardly depending handle and a pivotally securable door. Said door includes various resilient pockets of varying internal dimensions to secure therein various components of the game kit including an arm band, a wallet-badge, a compass, whistle, flashlight, pen, and book wherein said door further has integrally secured thereto an LED clock. Further included are a vertical series of parallel compartments for housing a binocular set, a plurality of hand-held ground to ground radios, a camera, and a plurality of overlying slidably removable drawers for containment of the various rules, regulations, and miscellaneous items associated with the game kit.

My invention resides not in any one of these features per se, but rather in the particular combination of all of them herein disclosed and claimed and it is distinguished from the prior art in this particular combination of all of its structures for the functions specified.

There has thus been outline, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved child's criminal investigative game kit which has all the advantages of the prior art games kits and none of the disadvantages.

It is another object of the present invention to provide a new and improved child's criminal investigative game kit which may be easily and efficiently manufactured and marketed.

It is a further object of the present invention to provide a new and improved child's criminal investigative game kit which is of a durable and reliable construction.

An even further object of the present invention is to provide a new and improved child's criminal investigative game kit which is susceptible of a low cost of manufacture with regard to both materials and labor, and which accordingly is then susceptible of low prices of sale to the consuming public, thereby making such child's criminal investigative game kits economically available to the buying public.

Still yet another object of the present invention is to provide a new and improved child's criminal investigative game kit which provides in the apparatuses and methods of the prior art some of the advantages thereof, while simultaneously overcoming some of the disadvantages normally associated therewith.

Still another object of the present invention is to provide a new and improved child's criminal investigative game kit including a self-contained compartmentalized carrying case having positionable therein the various components and elements comprising the features of the game.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 4 is a top orthographic view of an initiation card of allegiance as utilized with the instant invention.

FIG. 5 is a top orthographic view of identification card as utilized by an individual participating in the game kit of the instant invention.

DESCRIPTION OF THE PREFERRED EMBODIMENT

Figure 1:
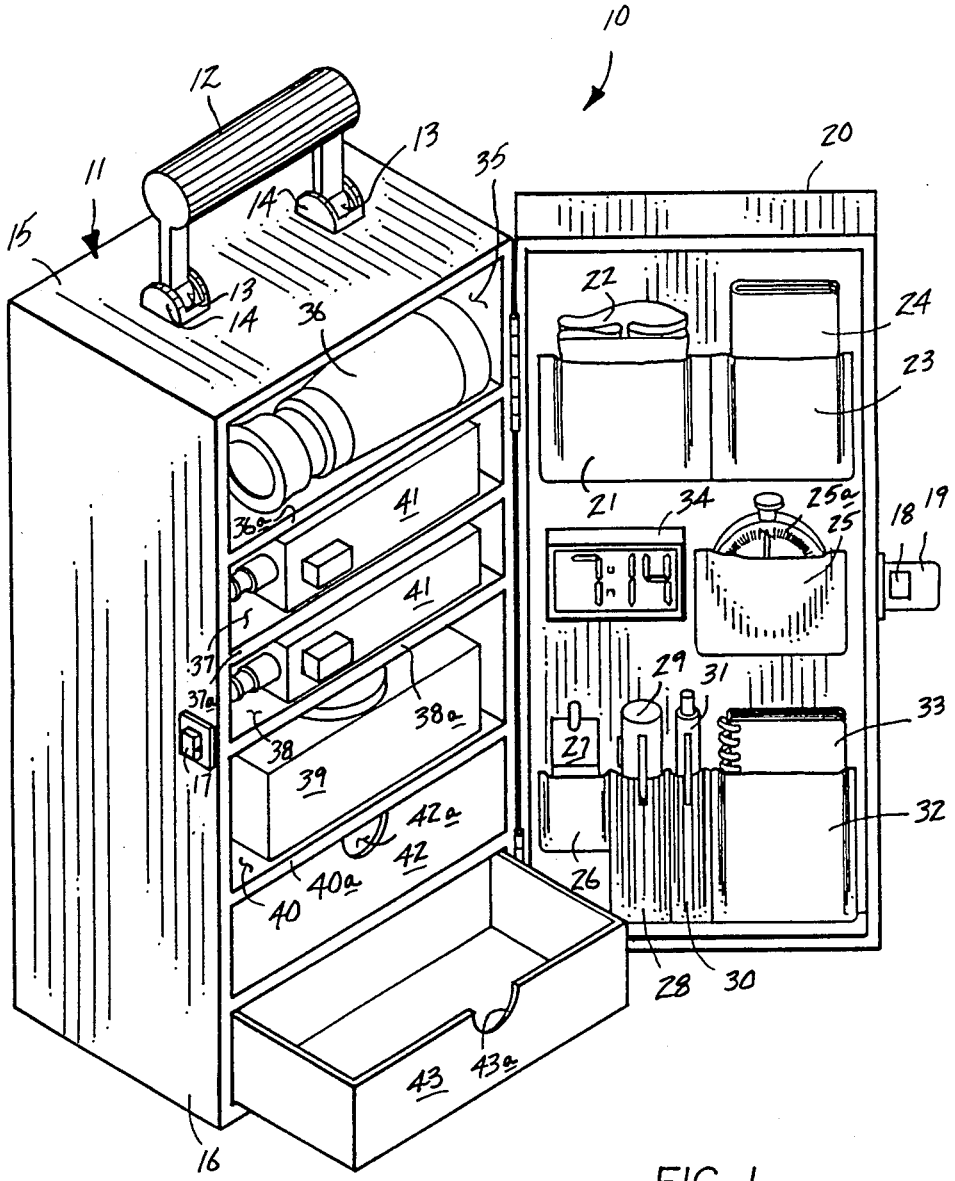
FIG. 1 is an isometric illustration of the instant invention with the various components secured within companion compartments of a container associated with the invention.

With reference now to the drawings, and in particular to FIG. 1 to thereof, a new and improved child's criminal investigative game kit embodying the principles and concepts of the present invention and generally designated by the reference numeral 10 will be described.

More specifically, it will be noted that the child's criminal investigative game kit 10 essentially comprises an elongate portable carrying container 11 formed with a top surface 15 having integrally secured thereto a plurality of spaced parallel bifurcated socket stanchions 14 accepting enlarged curvilinear feet 13 therein has terminal ends of a plurality of parallel legs integrally secured to an elongate pivotal handle 12 arranged parallel to top surface 15. A first side of the container 11 has formed proximate an interior edge a springbiased clasp 17 cooperating with an opening 18 of a latch 19 that is integrally formed to an associated pivotal door 20. The pivotal door 20 is secured to the container 11 by a plurality of spaced aligned hinges, as illustrated in FIG. 1.

An interior surface of the pivotal door 20 has formed a series of flexible pouches for securement of various components associated with the instant invention. A first pouch 21 secures an arm band 22 therein. A second pouch 23 securedly maintains and identification wallet 24 therewithin, a third pouch 25 secures a compass 25*a* therein, a fourth pouch 26 secures a whistle 27 therein, a fifth pouch 28 contains an elongate flashlight 29 therein, a sixth pouch 30 contains an elongate writing instrument 31, and seventh pouch 32 secures a notebook therein. Fixed integrally to the interior surface of the door 20 is a LED clock 34 utilized for compactness of structure and typically has included a self-contained battery pack, as is typical with such electronic time pieces.

Figure 2:
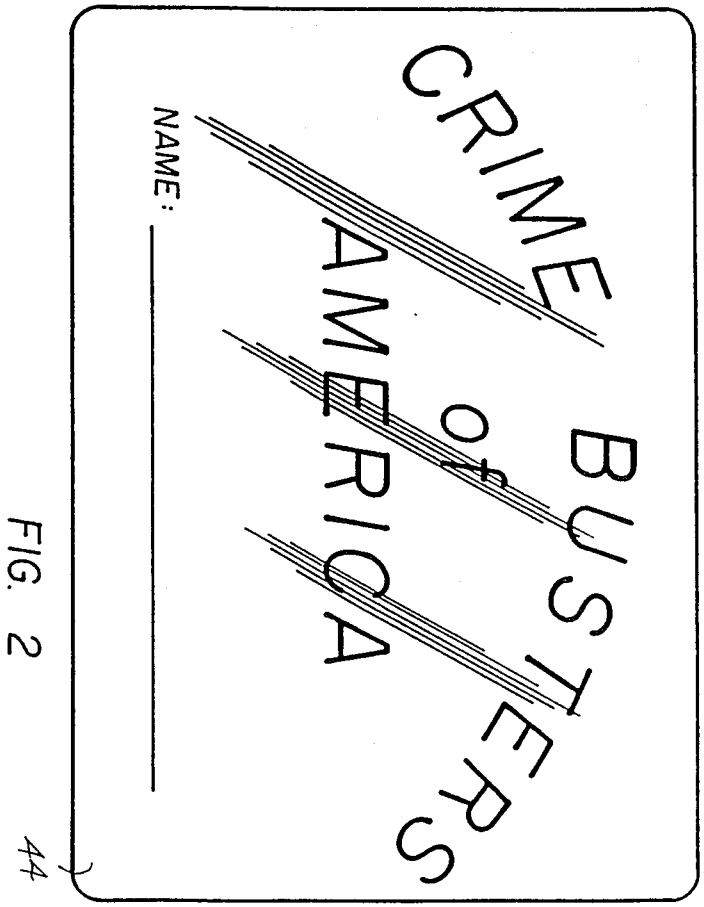
FIG. 2 is a top orthographic view of an identification card as utilized with the instant invention.
Figure 7:
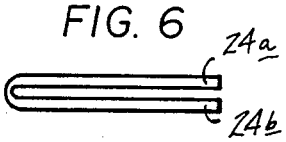
FIG. 7 is an end orthographic view taken in elevation of an identification wallet as utilized in the instant invention.
Figure 8:
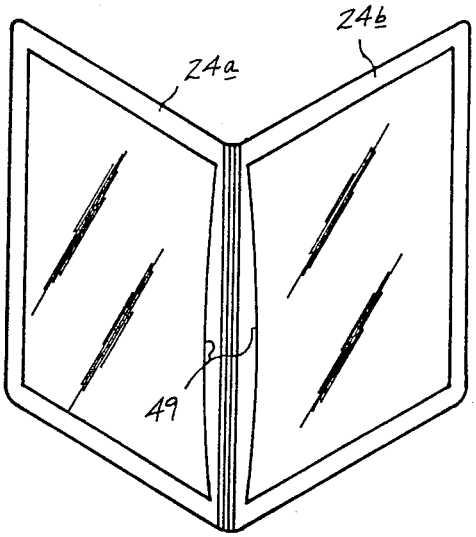
FIG. 8 is an isometric illustration of the game wallet as utilized by the instant invention.

The interior of the container 11 has formed therein a vertically stacked series of compartments, as illustrated in FIG. 1. Specifically, a first compartment 35 contains a pair of binoculars 36 defined by a first shelf 36*a* parallel to the top surface 15. A second compartment 37 defined by a second shelf parallel to the first shelf 36*a* and a third compartment 38 defined by an underlying third shelf 38*a* and overly second shelf 37*a* has included space for acceptance of a plurality of communication radios 41. Underlying compartment 38 is a fourth compartment 40 defined by the overlying third shelf 38*a* and underlying fourth shelf 40*a* for containment of a camera 39 therein. Underlying the above series of compartments is a first sliding drawer 42 and a second sliding drawer 43 each formed with a respective first semi-circular recess 42*a* and a second semi-circular recess 43*a* for access by an individual to enable opening of the drawers 42 and 43. The drawers are for containment of miscellaneous and accessory items that may be utilized with the instant invention as a child's imagination may require. FIG. 2 is illustrative of a typical identification card 44 as utilized and contained within a compartment 49, as illustrated in FIG. 8, formed with a transparent covering for visual observation of the included identification card 44 or associated first badge 47, as illustrated in FIG. 5. The wallet 24 is formed with a first side 24*a* and a second side 24*b* pivotally confronting each other by means of a flexible medial seam, as illustrated in FIGS. 7 and 8.

Figure 3:
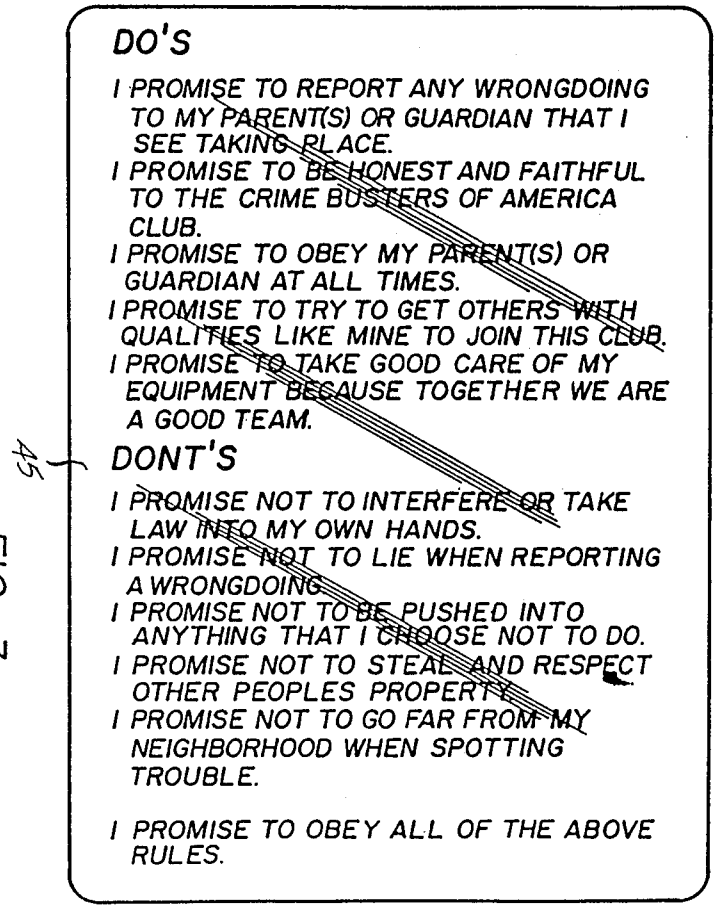
FIG. 3 is top orthographic illustration of rules and themes utilized in the participation by individuals of the instant invention.
Figure 6:
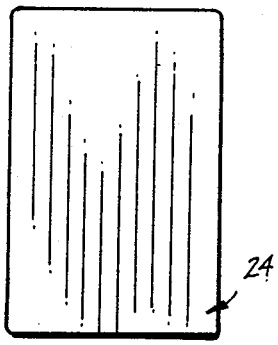
FIG. 6 is a top orthographic view of an identification wallet as utilized by the instant invention.

FIG. 3 is illustrative of a rules and theme card 45 setting forth the series of guidelines of desired moralistic values to be utilized by a youthful individual participating in the game of the instant invention. FIG. 4 sets forth the initiation and allegiance card 46 for further enhancing and re-enforcing desired and predetermined moralistic guidelines for the training and teaching of youthful individuals participating in the kit comprising the game of the instant invention.

Figure 9:
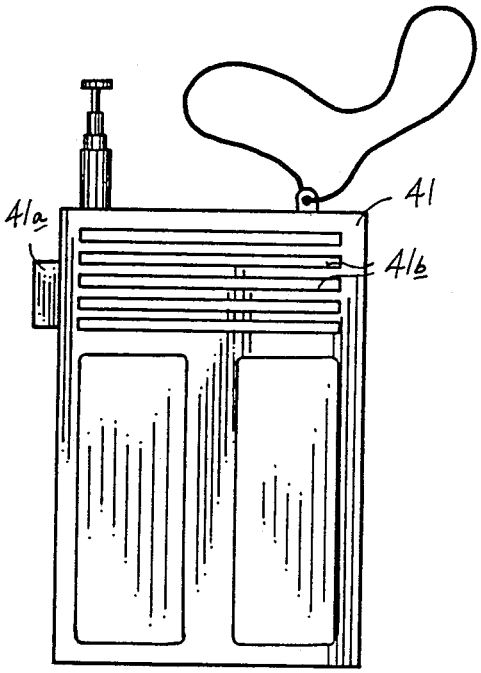
FIG. 9 is an orthographic view taken in elevation of a typical communication radio as utilized by the instant invention.

Attention to FIG. 9 sets forth the communication radios utilized by the instant invention provided with a transmit button 41*a* to be depressed upon transmission of a communication and release for reception of a communication by means of an associated speaker-microphone 41*b* of conventional well known construction in communication radios.

Figure 10:
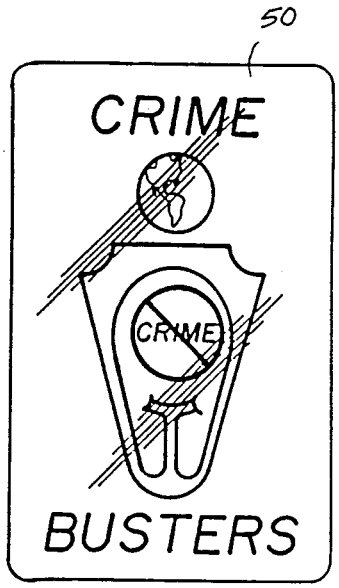
FIG. 10 is a top orthographic view of a badge as utilized by the instant invention.
Figure 11:
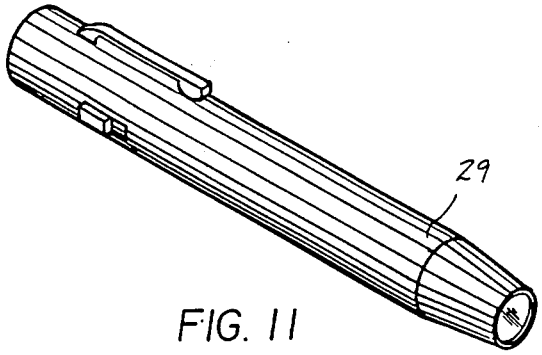
FIG. 11 is an isometric illustration of a flashlight as utilized by the instant invention.
Figure 12:
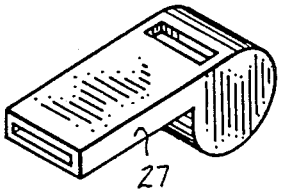
FIG. 12 is an isometric illustration of a whistle as utilized by the instant invention.
Figure 13:
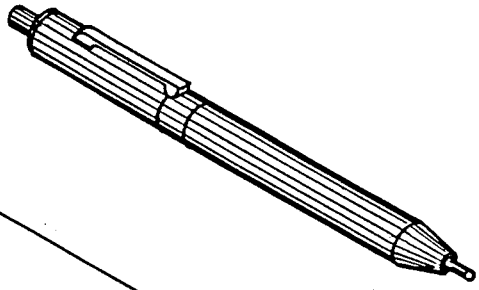
FIG. 13 is an isometric illustration of a writing instrument as utilized by the instant invention.
Figure 14:
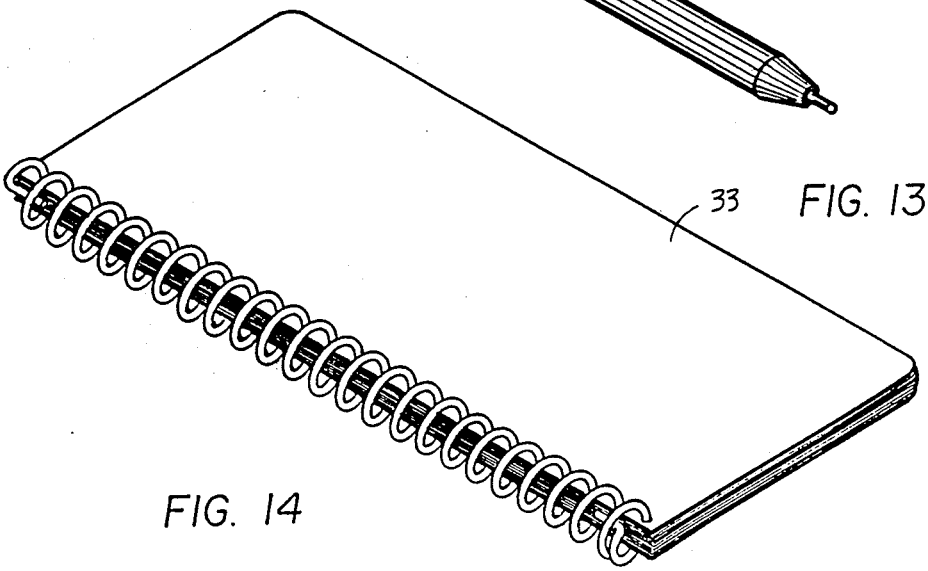
FIG. 14 is an isometric illustration of a notebook as utilized by the instant invention.
Figure 15:
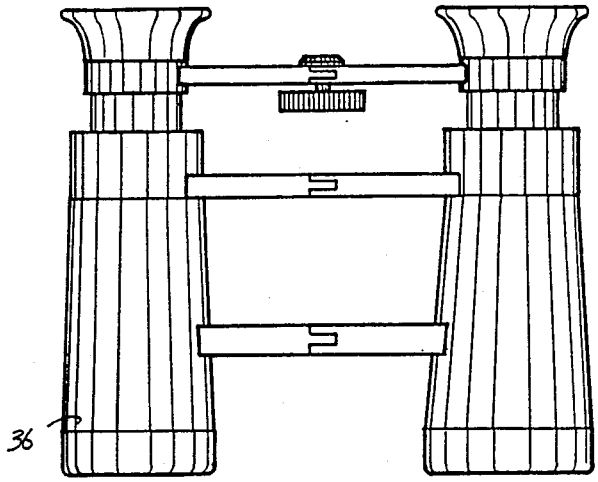
FIG. 15 is an orthographic illustration taken in elevation of binoculars as utilized by the instant invention.
Figure 16:
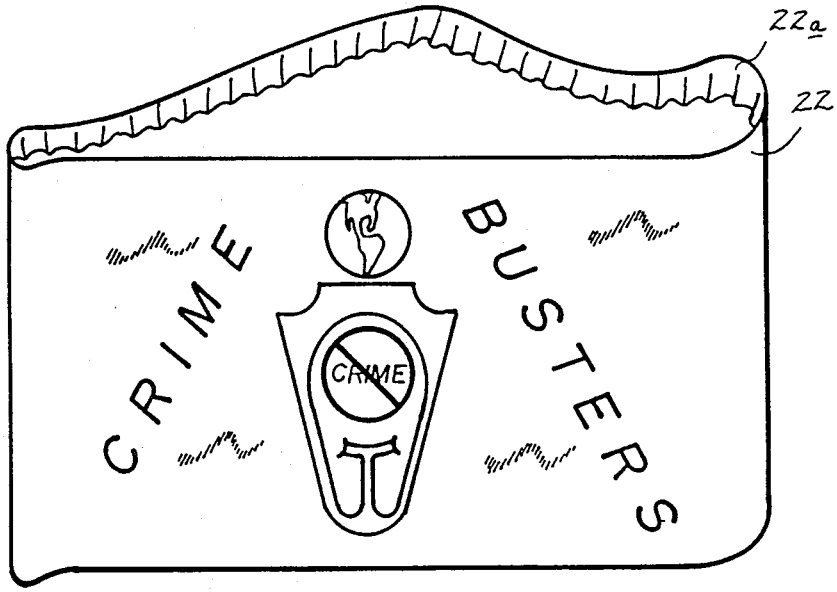
FIG. 16 is an isometric illustration of an arm band as utilized by the instant invention.

FIG. 10 is illustrative of a second optional apparel badge 50 that may be worn on an exterior garment by an individual to re-enforce the themes and guidelines associated with the game kit of the instant invention. Similarly, the arm band 22 formed with a resilient periphery 22*a*, as illustrated in FIG. 16, is utilized similarly for exterior wear to identify the various participants of the instant game kit 10.

The container 11 may be formed of any desirable or suitable material which is durable to withstand the impacts of children participating and utilizing a container and accordingly, material such as aluminum, plastic-like material, and steels and alloys thereof may be utilized to conserve weight and provide impact resistant construction.

The invention provides a compartmentalized container for the securement of associated components utilized in the participation and teaching derived thereof in the operative employment of the child's criminal investigative game kit 10. It is desired that a series of the initiation and allegiance card 46 be provided as well as the rules and theme card 45 for distribution to a plurality of children that may desire to participate in the use of the components within the container 11. The cards 45 and 46 accordingly may be stored within one of the sliding drawers 42 or 43.

The manner of usage of the components is to a large extent on the limits of a participating child's imagination whereas the various components are synergistically associated to provide a child with the optional use of one or more of the components to enhance a child's cooperative skills in a peer group and heighten investigative, imaginative, and deductive powers a participating child may possess.

Accordingly, no further discussion relative to the manner of usage and operation will be provided as the same should be apparent from the above description.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by letters patent of the United States is as follows:

1. A child's criminal investigative game kit comprising in combination, an elongate vertical container formed with a carring handle pivotally secured on a top surface of said container;

a single hinged vertical door pivotally secured to said container and formed with a latch on said door selectively securable to a spring-loaded clasp mechanism proximate an edge of said container;

the door including an interior surface with a plurality of flexible pouch means secured to the interior surface for positioning a like plurality of game kit components therein;

said container formed with a series of vertically stacked compartments for selective positioning of a like number further game kit components therein, and slidable drawer means reciprocatably removable from said container underlying said compartments for securement of a plurality of rules and theme cards and allegiance cards therein for distribution, and wherein said handle comprises an elongate portion formed with a plurality of legs secured to either terminal end of said portion with each of said legs terminating in arcuate surfaces securable within spaced bifurcated stanchions, said stanchions integrally secured to the top surface of said container, and wherein said pouch means includes a first pouch securing an arm band for selective removal from said pouch means and securement about an arm of a child;

a second pouch selectively securing therein an identification wallet wherein said identification wallet has a plurality of pockets therein for securement of an identification card and a first badge card;

said first pocket and said second pocket aligned in a first row;

an LED clock device secured underlying said first pouch and aligned therewith and adjacent a third pouch wherein said third pouch selectively secures therein a compass;

a fourth pouch underlying said LED clock and defining a third row securing a whistle therein;

a fifth pouch adjacent said fourth pouch selectively securing a flashlight therein, a sixth pouch adjacent said fifth pouch securing a writing instrument therein, and a seventh pouch adjacent said sixth pouch selectively securing a notebook therein.

2. A child's criminal investigative game kit as set forth in claim 1 wherein said compartments includes a first compartment adjacent said top surface for selectively securing a pair of binoculars therein;

a second compartment and a third compartment for securement of a communication radio within said second compartment and said third compartment, a fourth compartment aligned with and underlying said first, second and third compartment for securement of a camera therein.

3. A child's criminal investigative game kit as set forth in claim 2 wherein said drawer means include a first and second drawer means underlying and aligned with said compartments wherein each drawer comprises a removable portion formed with an exterior surface having a semi-circular recess formed therein for manual grasping by a user.

* * * * *